United States Patent [19]

Robinson

[11] Patent Number: 5,028,194

[45] Date of Patent: Jul. 2, 1991

[54] MARINE CRANE IMPROVEMENT

[76] Inventor: James S. Robinson, 7219 Northampton, Houston, Tex. 77055

[21] Appl. No.: 478,912

[22] Filed: Feb. 12, 1990

[51] Int. Cl.[5] ..... B63G 27/00; B66C 23/52

[52] U.S. Cl. ..... 414/139.6; 254/900; 212/191; 114/230

[58] Field of Search ..... 414/138.2, 138.4, 139.6, 414/138.7, 140.3, 140.4, 141.4, 141.5, 141.7, 142.6, 142.7, 142.8; 254/900, 361; 212/190–192, 156, 195–198, 223; 114/230; 441/3, 29; 166/355

[56] References Cited

U.S. PATENT DOCUMENTS

| | | | |
|---|---|---|---|
| 2,852,936 | 9/1958 | Broussard | 254/900 |
| 3,785,511 | 1/1974 | Bonnamy et al. | 414/139.7 |
| 4,025,055 | 5/1977 | Strolenberg | 254/361 |
| 4,126,298 | 11/1978 | Lub | 212/190 |
| 4,147,330 | 4/1979 | Eik | 414/139.6 |
| 4,277,053 | 7/1981 | Simon | 414/138.4 |
| 4,544,137 | 10/1985 | Johnson | 414/139.6 |

FOREIGN PATENT DOCUMENTS

| | | | |
|---|---|---|---|
| 6814804 | 4/1970 | Netherlands | 254/900 |
| 171752 | 5/1965 | U.S.S.R. | 414/141.7 |
| 433057 | 1/1976 | U.S.S.R. | 414/138.4 |
| 549378 | 3/1977 | U.S.S.R. | 414/138.2 |
| 627011 | 10/1978 | U.S.S.R. | 212/191 |
| 644715 | 1/1979 | U.S.S.R. | 212/191 |
| 677989 | 8/1979 | U.S.S.R. | 414/138.4 |
| 1261836 | 10/1986 | U.S.S.R. | 212/191 |
| 697810 | 9/1953 | United Kingdom | 212/191 |
| 2019317 | 11/1971 | United Kingdom | 212/191 |
| 1339131 | 11/1973 | United Kingdom | 254/900 |

*Primary Examiner*—Joseph F. Peters, Jr.
*Assistant Examiner*—R. B. Johnson
*Attorney, Agent, or Firm*—Pravel, Gambrell, Hewitt, Kimball & Krieger

[57] ABSTRACT

The present invention relates to an improvement in marine cranes.

An additional controllable variable lifting capability is operably connected to the load line of a marine crane, which may be motion compensated, to provide a safe initial lift of the cargo from a supply vessel. The additional lifting capability may be used alone or in concert with the drawworks to make the initial portion of the cargo lift.

A variation of the improvement may be used in mooring of vessels adjacent a marine installation.

2 Claims, 1 Drawing Sheet

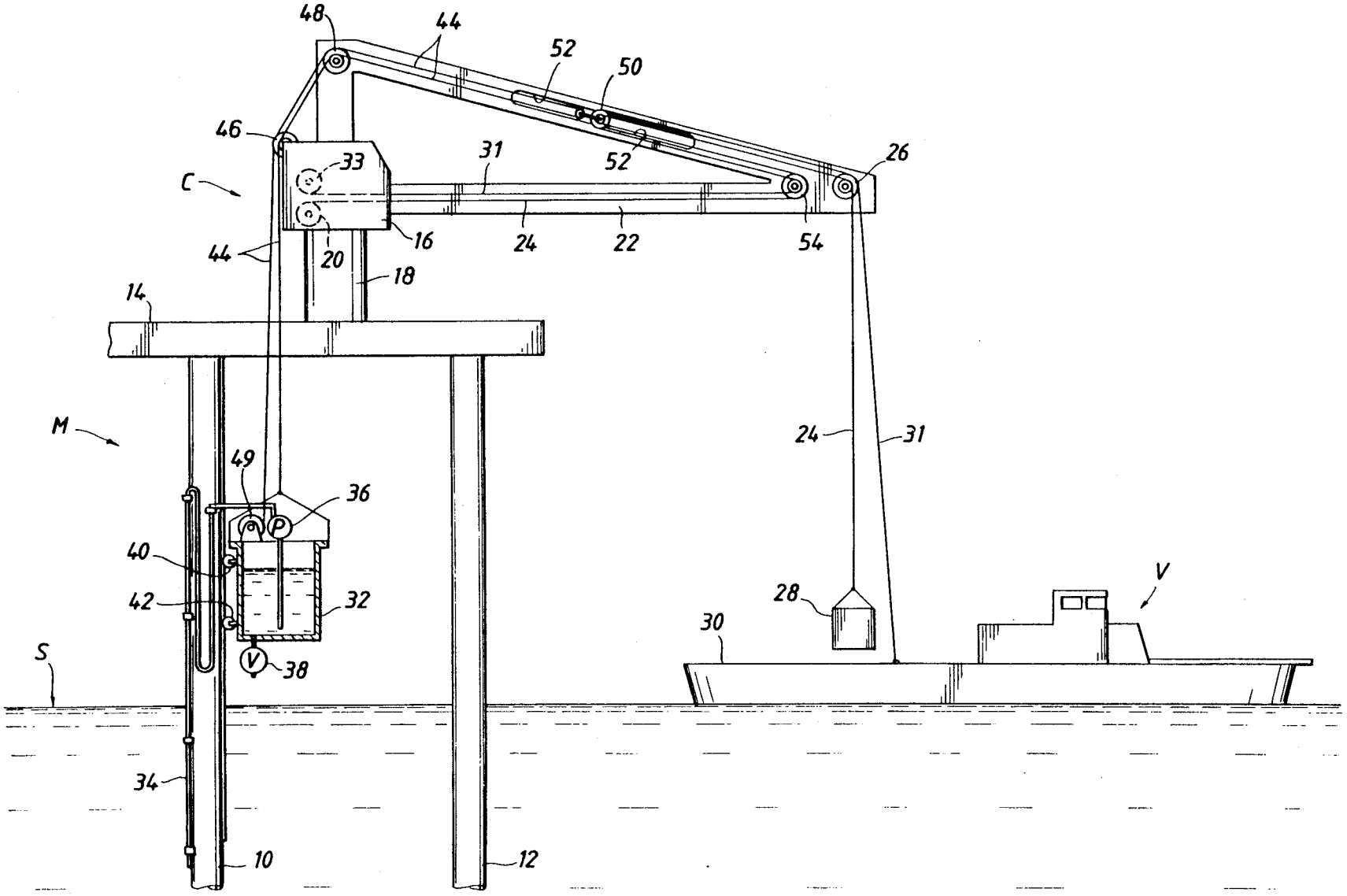
V
26
31
54
24
28
30
50
52
22
52
24
31
12
44
16
18
33
20
36
32
48
38
46
49
10
C
44
40
42
34
14
M
S

MARINE CRANE IMPROVEMENT

TECHNICAL FIELD

The present invention relates to marine cranes and particularly to marine cranes for loading and unloading cargo from a vessel which moves relative to the crane by wave motion.

In the operation of marine cranes, wave motion can create hazardous conditions. In heavy weather, transfer operations become extremely difficult and apart from the danger to crew members, the risk of damage to the crane, vessels, or cargo is unacceptable. As supplies must arrive regularly at offshore oil installations in all weather conditions, a fast and safe manner of transfer is required.

BACKGROUND ART

A device for transferring heavy loads at sea is disclosed in U.S. Pat. No. 3,945,508 to Colin. The disclosed device employs an inverted V-shaped cargo boom having one leg mounted on each ship. With such arrangement transfers can only occur during periods of calm seas.

U.S. Pat. Nos. 3,428,194 and 4,027,800 disclose marine gantry cranes for handling barges aboard ship while Pat. No. 3,757,678 discloses a marine crane for handling logs.

A combined marine ramp transfer and mooring system is disclosed in U.S. Pat. No. 4,003,473. The ramp connects the two vessels enabling transfer of personnel and/or material between the two.

Trolley type of high line transfer systems between ships are disclosed in U.S. Pat. Nos. 3,012,518 and 3,787,031. This type of system requires that the highline cable be connected between ships prior to cargo transfer.

Motion compensation systems for cranes and other cargo transfer equipment mounted on vessels have been developed. In U.S. Pat. No. 4,021,019 a heave compensated crane is disclosed for holding a load at a fixed position. A tide compensation system for a vessel is disclosed in U.S. Pat. No. 3,9I6,8Il.

Marine crane motion compensation systems are disclosed in U.S. Pat. Nos. 3,591,022; 3,662,991; and 4,I26,298. These systems are particularly useful on ships operating under rough sea conditions as they ensure non-impact and precise placement of the cargo. Such systems require a line connected to the cargo carrying surface of the other vessel as well as a load carrying line. Such a system can be provided with means to ensure that the cargo is lifted from the cargo carrying surface of the vessel at the wave crest of the relative motion cycle as disclosed in U.S. Pat. No. 4,025,055.

DISCLOSURE OF THE INVENTION

In accordance with the present invention, a motion compensation improvement for marine lifting devices is provided where there is relative movement caused by wave action between the lifting device and the surface upon or from which an object is being lowered or lifted. The improvement resides in an additional controllable variable lifting capability supplementing the lifting device drawworks. The additional controllable variable lifting capability is connected to the lifting line of the device and also separately connected to the surface upon or from which an object is being lowered or lifted.

This permits the lifting device to safely move in response to wave action while the cargo is being lifted.

Although the illustration and explanation refer to a container capable of being filled with and emptied of water to provide the additional controllable variable lifting capability, it is to be understood that other means well-known to those skilled in the arts may be used to provide the controllable variable lifting capability without departing from the spirit of the invention. Also, although the illustration and explanation refer to the fast line as the separate connection, it is to be understood that other means of connecting the surface of the vessel and the additional controllable variable lifting capability may be used without departing from the spirit of the invention.

In the illustrated embodiment, the controllable variable lifting capability is a container supported by a crane and which can be filled with and emptied of water. The container is connected to both the load carrying line and the fast line of the crane in a manner which will permit the fast line to be connected to the surface of the vessel and the load carrying line to be connected to the cargo. By connecting the fast line to the surface of the vessel while the container is empty, and then tightening the fast line, the empty container can be made to move in response to the movement of the vessel. The cargo line, which the lifting line of the device and also would be moving with the vessel, can then be safely connected to the cargo. The cargo line can then be tightened. With both the fast line and the cargo line tight, the container can be filled with water until the cargo weight is overcome. By shortening the cargo line and/or lengthening the fast line, the cargo can be lifted without shock loading the crane during the cargo lift. By reversing the procedure, cargo can be loaded onto the vessel without cargo damage. During periods of relatively calm seas, the additional controllable variable lifting capability may also be used either alone or with the crane drawworks to lift or deposit, or assist in the lift or deposit of the cargo from or onto the cargo carrying vessel.

BRIEF DESCRIPTION OF THE DRAWINGS

The FIG. is a side view, partially in section, of a marine installation having the improvement of the present invention installed on a marine crane.

BEST MODE FOR CARRYING OUT THE INVENTION

In the FIG., a marine installation, generally designated M, is illustrated extending above the water surface S. The marine installation M may be either a floating type such as a semisubmersible vessel or a fixed platform from which offshore operations may be conducted. In the illustrated embodiment support legs 10 and 12 extend upwardly from below the water surface S to a working platform or surface 14. Mounted on the work surface 14 is a marine crane, generally designated C, having a base 16 that is rotatably mounted upon a pedestal 18 in the usual manner. The pedestal 18 is secured to work platform 14 by suitable means as is well known to those skilled in the art. The crane base 16 mounts a drawworks including winches 20 and 33, and a crane boom 22 in the usual manner. A first or cargo cable 24 has one end connected to the winch 20 and extends outwardly on the boom around stationary sheave assembly 54 and movable sheave assembly 50 to sheave assembly 26 where it extends downwardly for lifting cargo 28 in the usual manner. The crane C serves to load and unload cargo 28 from a supply vessel V and in particular the cargo carrying surface or platform 30 of the vessel V.

A second line, in the illustration the fast line 31 of crane C, is connected to winch 33 and routed around stationary sheave assembly 54 and movable sheave assembly 50 to sheave assembly 26 where it extends downwardly and is secured to the cargo carrying surface 30 of the vessel V.

The container 32 is filled with sea water through conduit 34 by pump 36 that is mounted with the container 32 to increase container weight. A dump valve 38 enables emptying of the container 32 when desired. It will readily be understood also, that the operation of the pump 36 and the dump valve 38 may be remotely controlled from the crane base 16 if desired. A pair of rollers 40 and 42 guide the vertical movement of the container 32 by engagement with the leg 10.

A connector means or cable 44 supports the container 32 at one end and extends upwardly over pulley 46 mounted to the crane base 16 and over pulley assembly 48 also mounted with the crane base 16. Cable 44 is attached to a winch 49 mounted on the container 32. Cable 44 is also pivotally connected through movable sheave assembly 50 which is provided for movement within a long gap or groove 52 of the boom 22. The downward movement of the container 32 will be transmitted through the cable 44 to the movable sheave assembly 50 for moving the movable sheave assembly 50 along the slot 52 away from the sheave assembly 26 for shortening the lines 24 and 31 when the vessel V rises due to wave action. When the vessel V falls because of wave action, the movement of lines 24 and 31 will be transmitted through movable sheave assembly 50 and cable 44 to lift the container 32. Thus when it is desired to lift the cargo 28 from the cargo carrying surface 30, the container 32 can be filled with water until the weight of the container 32 exceeds the weight of the cargo 28 and then the cargo winch 20 may be used to ,shorten the cargo line 24, and/or the fast line winch 33 may be used to lengthen fast line 31, thereby smoothly lifting the cargo 28 from the surface 30 of the vessel V without damage to the equipment or personnel. Once the cargo 28 is well clear of the surface 30 of the vessel V, the fast line 31 can be slackened and disconnected and the lift completed as usual.

USE AND OPERATION

In the use and operation of the present invention, since lines 24 and 31 have different drawworks, line 31 can be slackened enough to permit fastening to the cargo carrying surface 30 of the vessel V, while the cargo hook of line 24 is safely above the vessel V.

If the container 32 is empty and midway in its movement range and movable sheave assembly 50 is midway in slot 52, line 31 can be fastened to the surface 30 of the vessel V and then tightened, causing the empty container 32 to move in response to the movement of the vessel V. The cargo carrying line 24 can then be safely attached to the cargo 28, since the cargo hook will also be moving with the vessel V. By increasing the weight of the container 32 until it exceeds the weight of the cargo 28, but not the capacity of the winch 20, and simultaneously lengthening line 31, the cargo 28 can be lifted smoothly without risk from damaging shock, loads to the crane, the cargo 28 or the vessel V. The cargo lift may be continued by either shortening the cargo line 24, lengthening the fast line 31 or simultaneously shortening line 24 and lengthening line 31.

When the cargo 28 is clear of the deck 30, the fast line 31 can be slackened, disconnected from the vessel V and retracted, and the winch 20 may then be used to move the cargo 28 into position and the crane rotated on the pedestal 18 to place the cargo 28 on the work: surface 14 in the usual manner.

The foregoing disclosure and description of the invention are illustrative and explanatory thereof and various changes in the size, shape and materials as well as in the details of the illustrated construction may be made without departing from the spirit of the invention.

I claim:

1. A marine crane for loading and unloading cargo from a marine vessel floating in water, said vessel being movable relative to the crane in response to the wave motion of said water, comprising:

a support structure;

said crane having a base rotatably mounted on said support structure, a boom mounted on said base and extending laterally therefrom, said boom having an elongated slot therein, a movable sheave assembly mounted in said slot and adapted to move to a plurality of positions along said slot, stationary sheaves mounted on said boom adjacent an end thereof;

a cargo winch and a fast line winch mounted on said base, a cargo cable with a pair of ends, one end of said cargo cable being attached to said cargo winch and the other end of said cargo cable being adapted to be removably connected to said cargo for vertically moving said cargo relative to said vessel upon actuation of said cargo winch, a fast line cable with a pair of ends, one end of said fast line cable being attached to said fast line winch and the other end of said fast line cable being removably connected to said marine vehicle;

said cargo and fast line cables being disposed about said stationary sheaves and said movable sheave assembly;

a water container mounted on said support structure for vertical movement thereon, a winch mounted on said container, a container cable having a pair of ends, one of said container cable ends being connected to said winch on said container, the other one of said container cable ends being connected to said container spacedly from said winch on said container, container cable guide sheaves mounted on said crane, a portion of said container cable between said pair of ends being disposed about said guide sheaves and said movable sheave assembly whereby movement of said marine vessel will produce corresponding motion in said container, cargo and fast line cables, and means mounted on said water container for varying the water volume therein to transfer cargo and/or supplement said cargo winch to transfer cargo relative to said marine vessel.

2. A marine crane as defined in claim 1 including rollers mounted on said water container for engaging said supporting structure.

* * * * *